US007686058B2

(12) United States Patent
Liang et al.

(10) Patent No.: US 7,686,058 B2
(45) Date of Patent: Mar. 30, 2010

(54) OPERATION HANDLE ASSEMBLY FOR CURTAINS

(75) Inventors: Wen Ying Liang, Fuxing Shiang (TW); Sheng Ying Hsu, Fuxing Shiang (TW); Wu Chung Nien, Fuxing Shiang (TW); Chien Chih Huang, Fuxing Shiang (TW)

(73) Assignee: Ching Feng Home Fashions Co., Ltd, Changhua County (TW)

( * ) Notice: Subject to any disclaimer, the term of this patent is extended or adjusted under 35 U.S.C. 154(b) by 2 days.

(21) Appl. No.: 12/071,726

(22) Filed: Feb. 26, 2008

(65) Prior Publication Data

US 2009/0194242 A1 Aug. 6, 2009

(30) Foreign Application Priority Data

Feb. 1, 2008 (TW) ..... 97202272 U

(51) Int. Cl.
*A47H 5/00* (2006.01)

(52) U.S. Cl. ..... 160/84.01; 248/316.7; 211/180

(58) Field of Classification Search ..... 160/84.01; 248/316.7, 316.1, 227.3, 230.7; 211/180
See application file for complete search history.

(56) References Cited

U.S. PATENT DOCUMENTS 4,673,153 A * 6/1987 Hilty et al. ..... 248/231.81
5,188,325 A * 2/1993 Hilty et al. ..... 248/224.8
5,713,542 A * 2/1998 Benoit ..... 248/71
6,220,557 B1 * 4/2001 Ziaylek et al. ..... 248/316.1
6,352,235 B2 * 3/2002 Cizek ..... 248/692
6,386,497 B1 * 5/2002 Guyomard et al. ..... 248/316.7
6,622,976 B1 * 9/2003 Ianello ..... 248/73
D537,331 S * 2/2007 Hill ..... D8/395
7,178,777 B1 * 2/2007 Banker ..... 248/316.7
7,422,181 B2 * 9/2008 Suβenbach ..... 248/56
7,465,063 B2 * 12/2008 Stillman ..... 362/225
2006/0102293 A1 * 5/2006 Wu ..... 160/84.01
2008/0149284 A1 * 6/2008 Lin ..... 160/377
2008/0179016 A1 * 7/2008 Lin ..... 160/84.01

* cited by examiner

*Primary Examiner*—Katherine W Mitchell
*Assistant Examiner*—Philip S Kwon

(57) ABSTRACT

A curtain includes a top rail and a sheet of fabric having a top end connected to the top rail, a handle assembly is connected to a lower end of the sheet of fabric. The handle assembly includes two transverse bars received in the sheet of fabric and two upright bars which are removably connected to the transverse bars via connection members connected to the transverse bars from outside of the sheet of fabric. The upright bars can be separated from the transverse bars so that the curtain can be folded.

3 Claims, 7 Drawing Sheets

SECTION:a-a

OPERATION HANDLE ASSEMBLY FOR CURTAINS

FIELD OF THE INVENTION

The present invention relates to a handle assembly for curtains and the handle assembly includes two removable upright bars which can be separated from the curtain to reduce the lengthwise space occupied.

BACKGROUND OF THE INVENTION

A conventional curtain generally is operated by cords and operation wand, however, the cords are hanging on the top rail and might trap or catch children so that a cord-less curtain 3 is developed which includes a cover sheet 31 which can be lifted or pulled by holding a handle 311 on the lower bar of the curtain as shown in FIG. 7. The handle 311 is fixed to the lower bar of the curtain 3 and projects axially from the lower bar. The handle 311 increases the space required when being transported. Another handle 312 of the cord-less curtain 3 is disclosed in FIG. 8, wherein the handle 312 actually is composed of two horizontal bars 313 and two vertical bars 314, the horizontal bars 313 and the two vertical bars 314 are located in the curtain 3 and located at lower end of the curtain 3 so that the user can easily access the handle 312. Again, the handle 312 involves four bars 313, 314 and occupy a lot space.

The present invention intends to provide a handle assembly for curtains and includes two transverse bars received in the curtain and two upright bars which are removably connected to the two transverse bars so that the two upright bars can be removed from the curtain and the curtain can be folded to be compact.

SUMMARY OF THE INVENTION

The present invention relates to a handle assembly for curtains and the assembly comprises two transverse bars received in the sheet of fabric of the curtain and two upright bars which are removably connected to the transverse bars. The upright bars are separated from the transverse bars so that the curtain can be folded to be compact.

The primary object of the present invention is to provide a handle assembly for curtains and the curtain includes two removable upright bars and the curtain is allowed to be folded when the two upright bars are separated from the curtain.

Another object of the present invention is to provide a handle assembly for curtains wherein the two removable upright bars are easily connected to the connection members on the transverse bars by engaging the grooves of the upright bars with the notches of the connection members.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
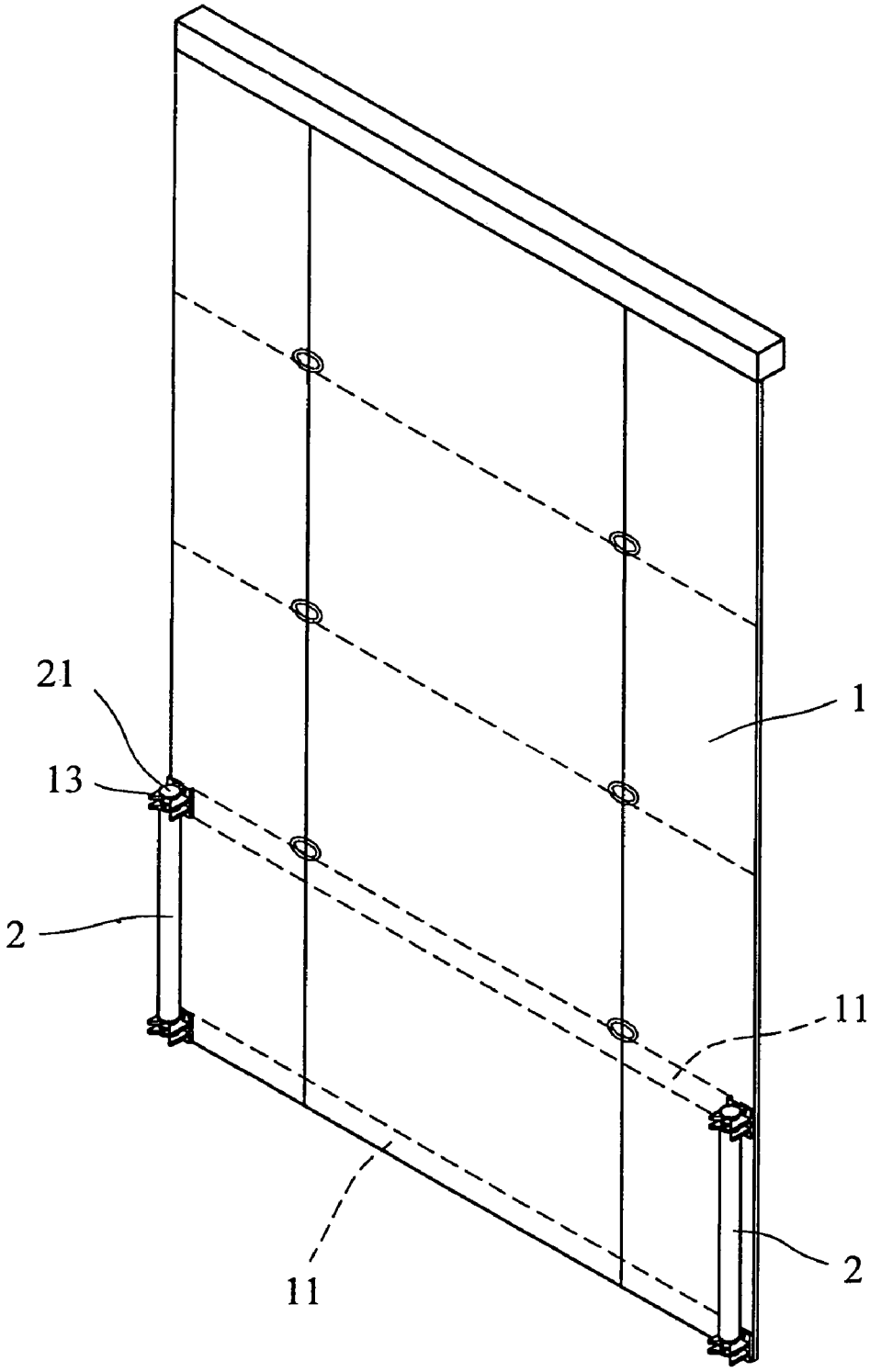
FIG. 1 is a perspective view to show the curtain and the handle assembly of the present invention.
Figure 2:
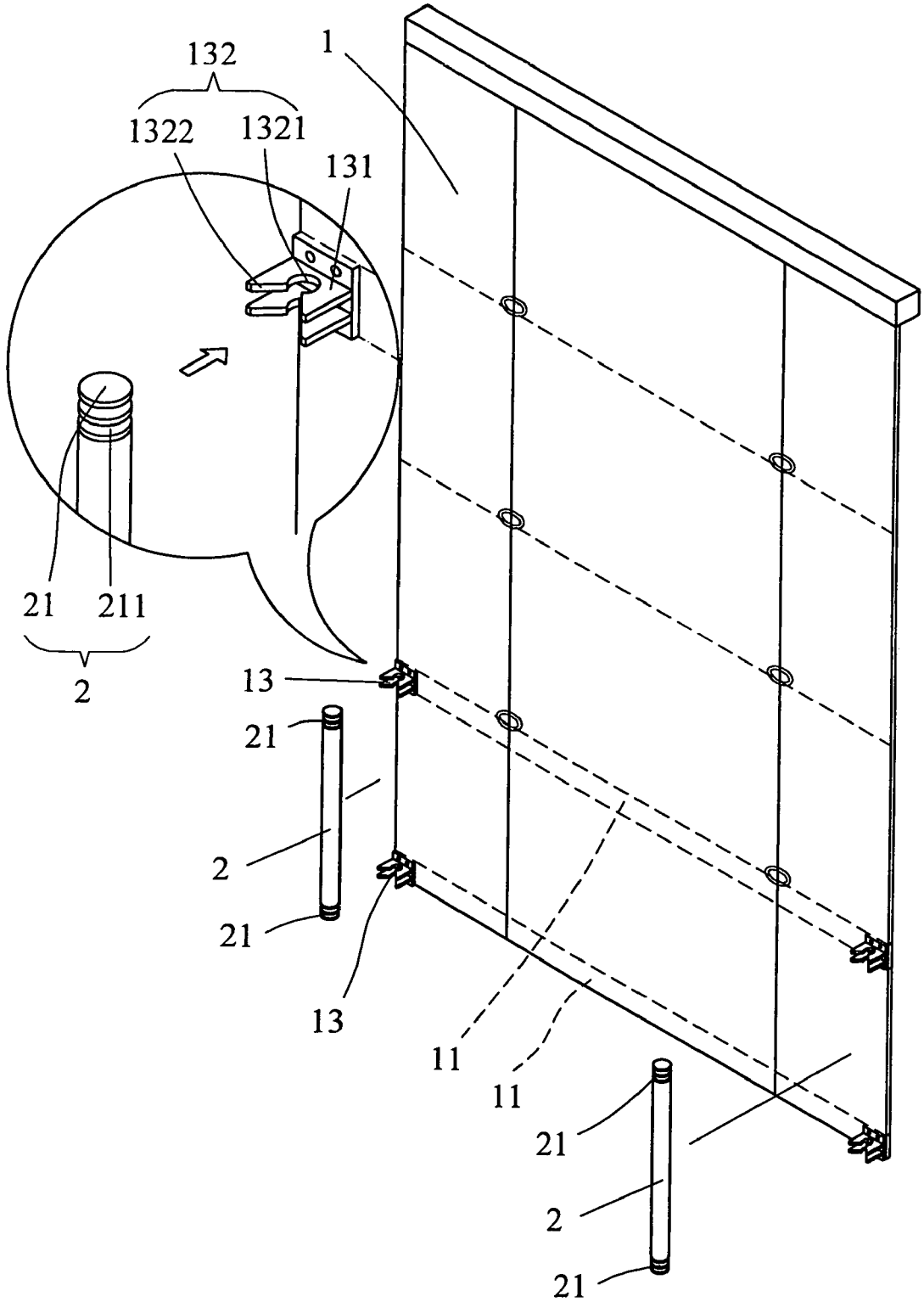
FIG. 2 is an exploded view to show the curtain and the handle assembly of the present invention.
Figure 3:
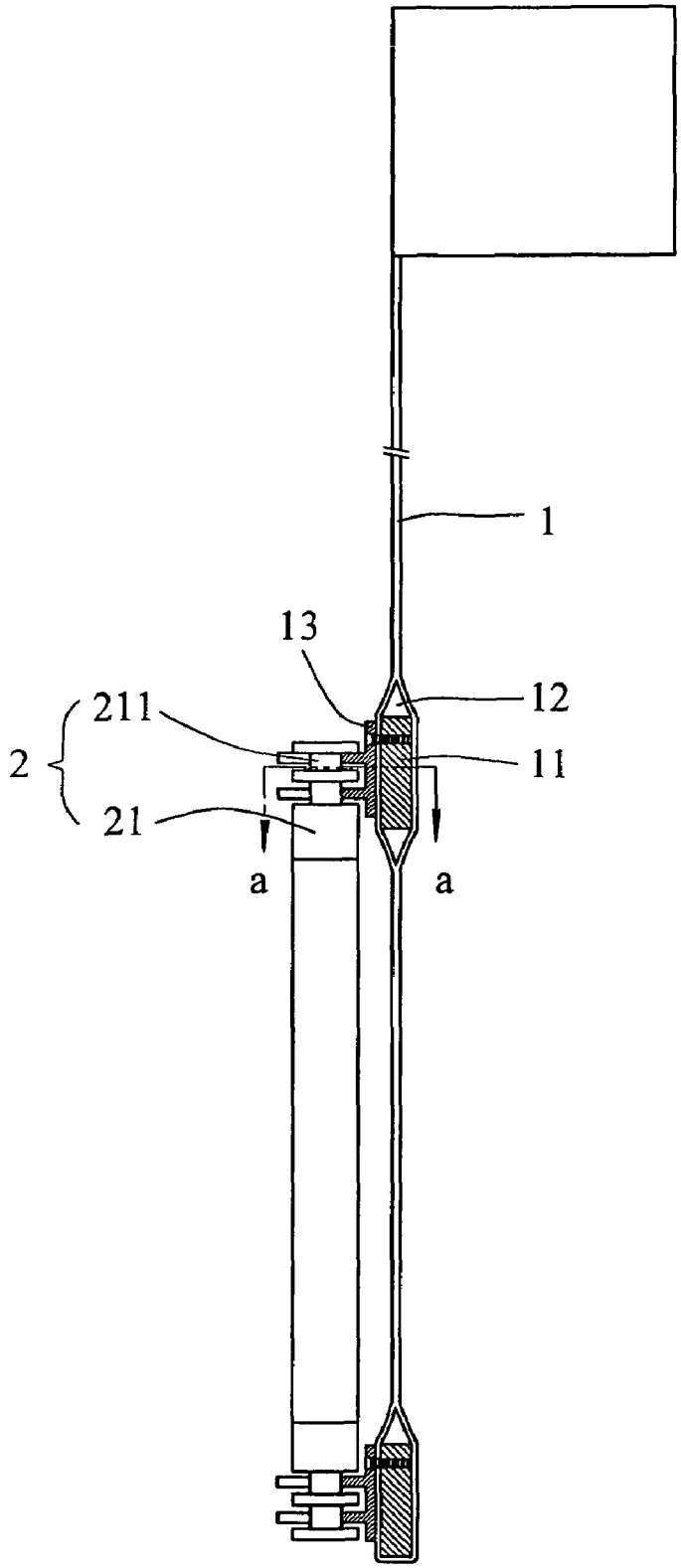
FIG. 3 is a partial cross sectional view of the curtain and the handle assembly of the present invention.
Figure 4:
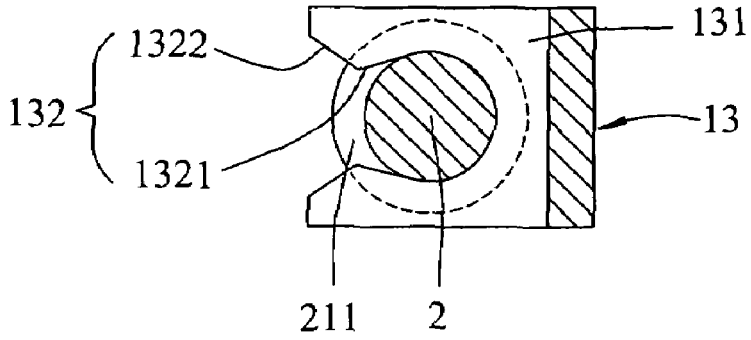
FIG. 4 is a top end cross sectional view of the engagement of the upright bar and the connection plates of the connection member of the present invention.

Referring to FIGS. 1 to 4, a curtain 1 of the present invention comprises a top rail and a sheet of fabric has a top end connected to the top rail. A handle assembly is connected to a lower end of the sheet of fabric. The sheet of fabric includes two elongate spaces 12 as shown in FIG. 3.

The handle assembly comprises two transverse bars 11 and two upright bars 2, the two transverse bars 11 are received in the elongate spaces 12 in the sheet of fabric and two connection members 13 are fixed to two ends of each of the two transverse bars 11 from outside of the sheet of fabric so that the connection members 13 extend from a surface of the sheet of the fabric. Each connection member 13 includes two plates 131 which are perpendicular to the sheet of the fabric and each plate 131 includes an engaging portion 132 which includes a notch 1321 and a dove-tailed opening 1322 which communicates with the notch 1321. In this embodiment, the notch 131 in each plate 131 of the connection member 13 is a round notch.

The two upright bars 2 each have two positioning ends 21 and each positioning end 21 includes two grooves 211 which are engaged with the notches 1321 of the two plates 131 of the connection member 13 via the dove-tailed openings 1322.

Figure 5:
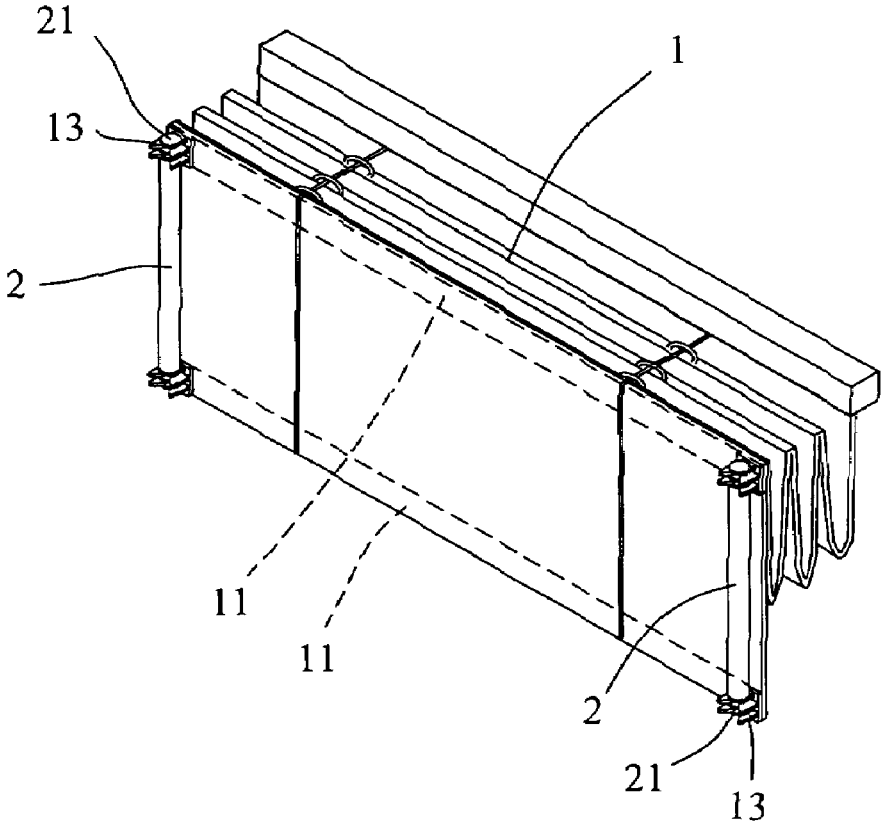
FIG. 5 is a perspective view to show the folded curtain wherein the upright bars are connected to the connection members.
Figure 6:
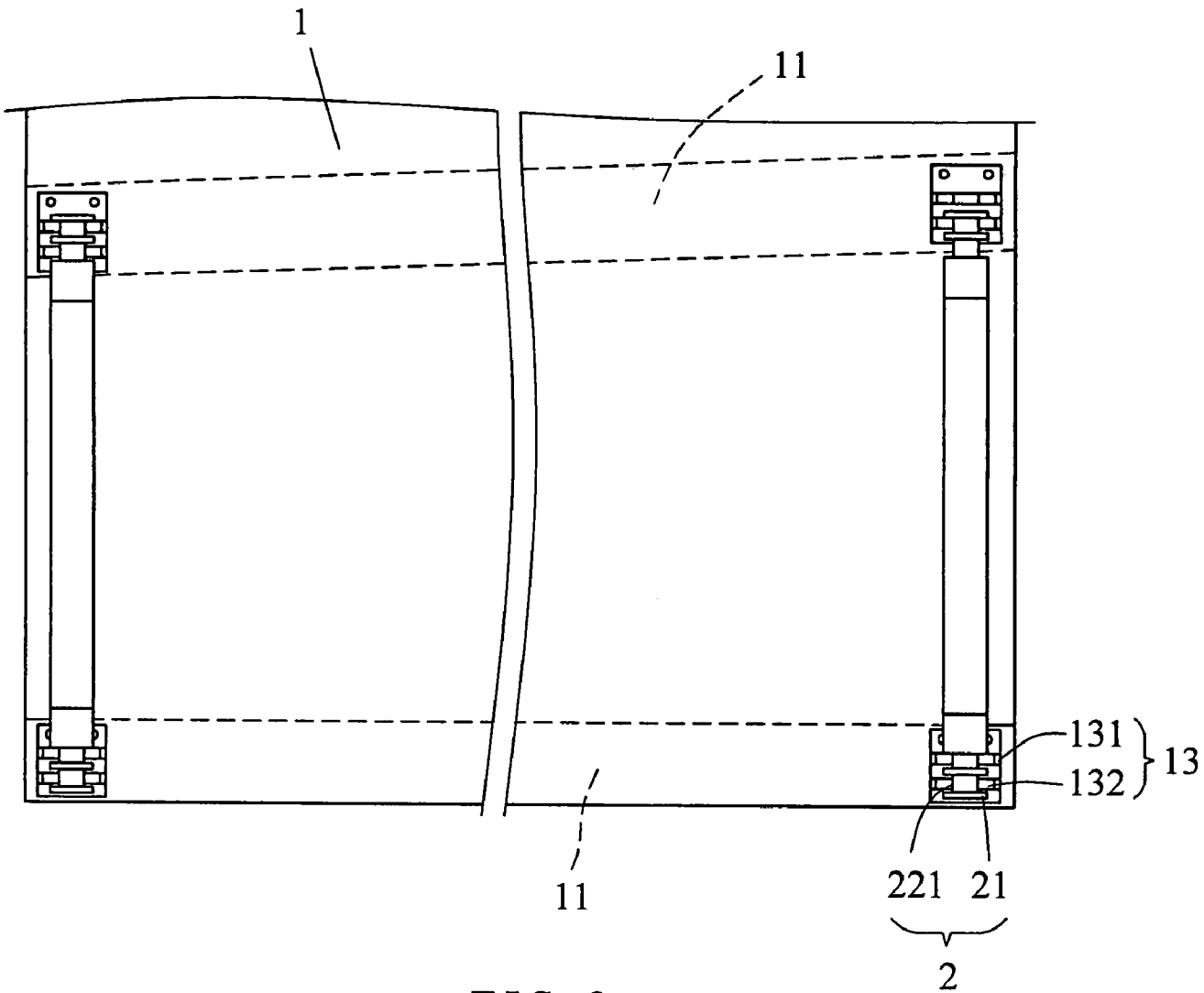
FIG. 6 shows the upright bars are connected to two non-parallel transverse bars.

As shown in FIG. 5, the two upright bars 2 are easily removed from the connection members 13 by pulling the upright bars 2 away from the connection members 13, such that the curtain 1 can be folded to be compact. The two upright bars 2 are also easily engaged with the connection members 13 simply to engage the positioning ends 21 with the connection members 13 which are located at lower end of the sheet of fabric and can be easily accessed for users.

Figure 7:
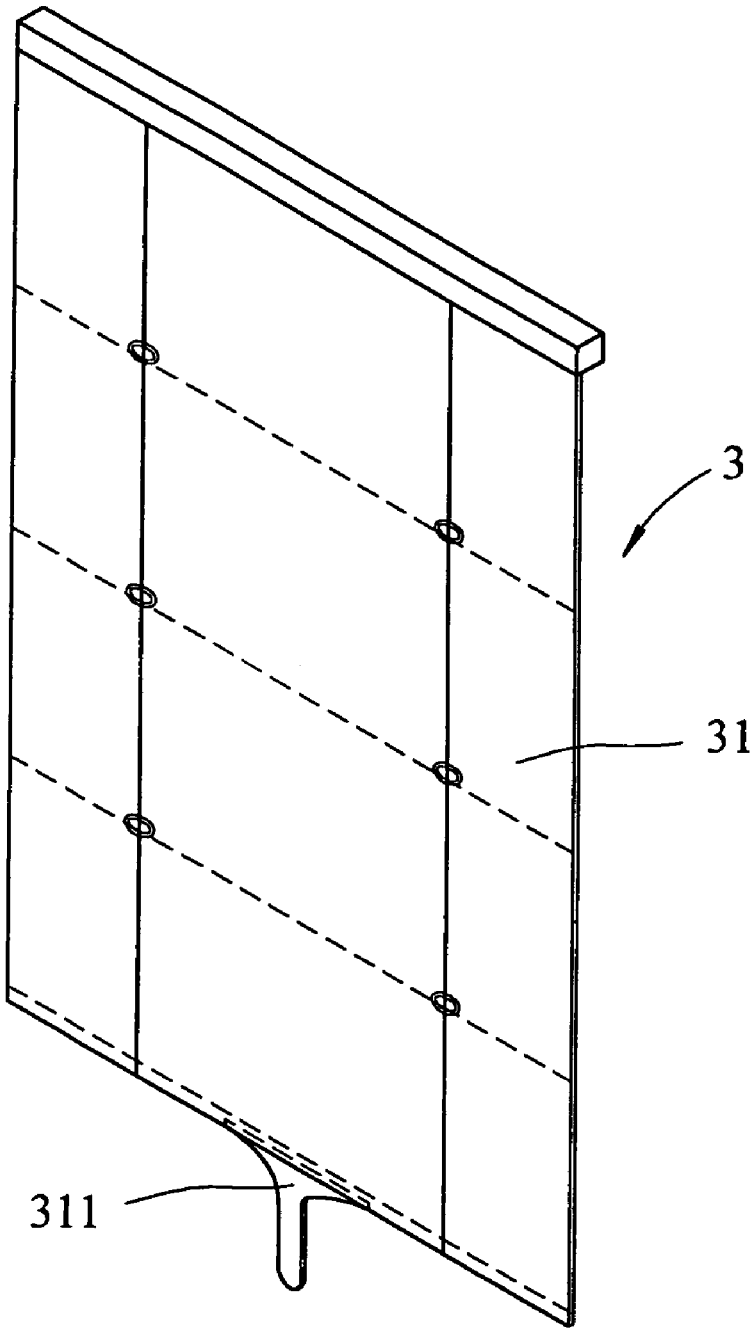
FIG. 7 PRIOR ART
FIG. 7 shows a conventional handle of a curtain.
Figure 8:
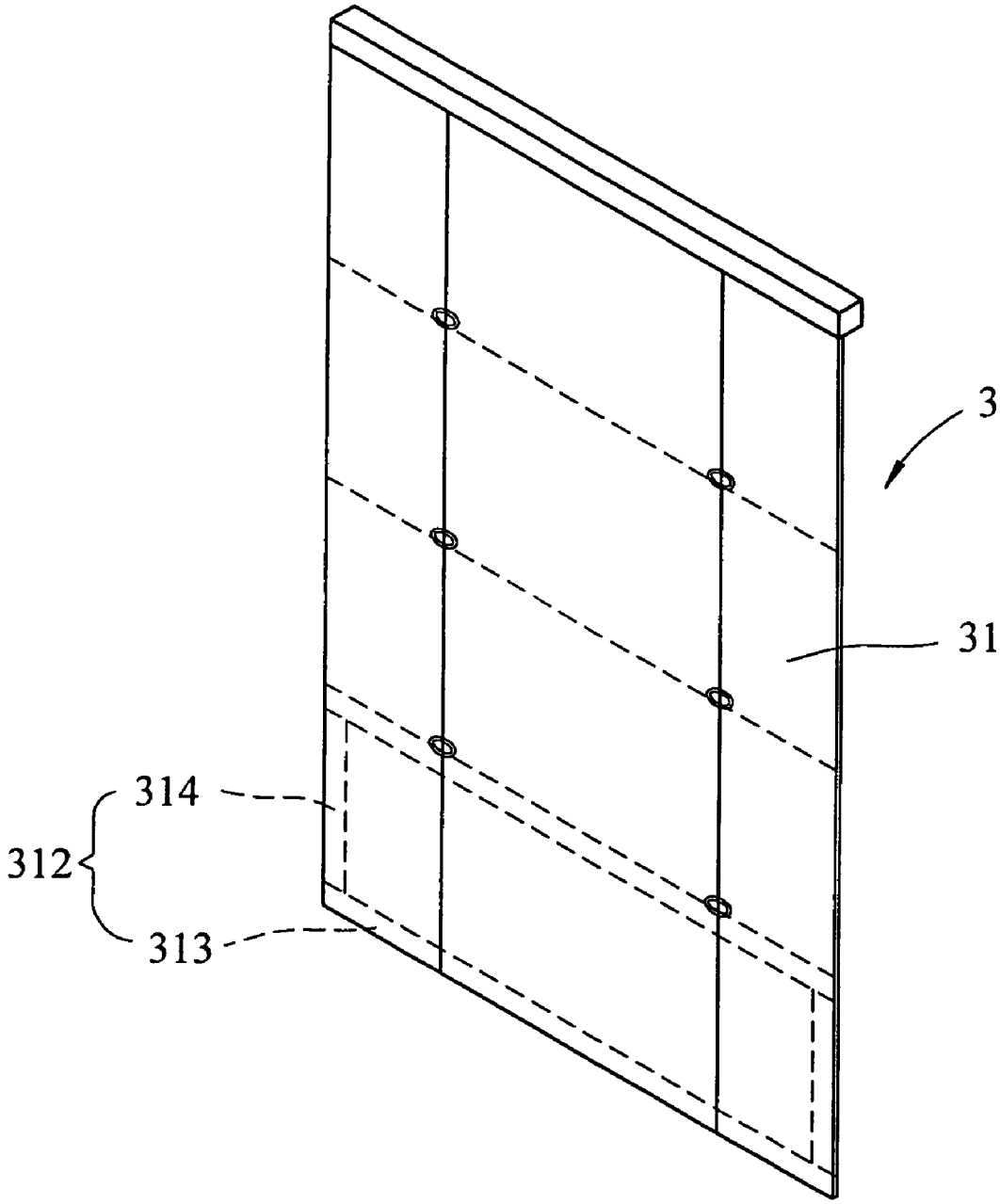
FIG. 8 PRIOR ART
FIG. 8 shows another conventional handle of a curtain.

FIG. 7 shows that if the two transverse bars 11 are non-parallel to each other, because the distance between the plates 131 of each connection member 13 is fixed, so that at least one of the connection members 13 can be connected with only one groove 211 of the positioning end 21 of one of the upright bars 2 so as to compensate the distance difference between the two transverse bars 11. By this way, the handle assembly can be functioned as well with minor tolerance when fabricating the transverse bars 11.

While we have shown and described the embodiment in accordance with the present invention, it should be clear to those skilled in the art that further embodiments may be made without departing from the scope of the present invention.

What is claimed is:

1. A curtain comprising:

a top rail and a sheet of fabric having a top end connected to the top rail, a handle assembly connected to a lower end of the sheet of fabric, the handle assembly comprising two transverse bars and two upright bars which are removably connected to the transverse bars, and the sheet of fabric including two elongate spaces in which the two transverse bars are received, each of the two transverse bars having two connection members on two ends thereof and the connection members extending from a surface of the sheet of the fabric, each connection member including two plates which are perpendicular to the sheet of the fabric and each plate including a notch, the two upright bars each having two positioning ends and each positioning end including two grooves which are engaged with the notches of the two plates of the connection member.

2. The curtain as claimed in claim 1, wherein each plate includes a dove-tailed opening which communicates with the notch.

3. The curtain as claimed in claim 1, wherein the notch in each plate of the connection member is a round notch.

* * * * *